US008289815B2

(12) United States Patent
Gracia et al.

(10) Patent No.: US 8,289,815 B2
(45) Date of Patent: Oct. 16, 2012

(54) TIMEPIECE WITH A PIVOTING CASE

(75) Inventors: Jean-Claude Gracia, Bienne (CH); Damien Goyet, Winkel (FR); Paulo Bravo, Hauterive (CH)

(73) Assignee: The Swatch Group Management Services AG, Biel (CH)

( * ) Notice: Subject to any disclaimer, the term of this patent is extended or adjusted under 35 U.S.C. 154(b) by 1001 days.

(21) Appl. No.: 12/096,729

(22) PCT Filed: Dec. 6, 2006

(86) PCT No.: PCT/EP2006/069363

§ 371 (c)(1),
(2), (4) Date: Oct. 1, 2008

(87) PCT Pub. No.: WO2007/065906

PCT Pub. Date: Jun. 14, 2007

(65) Prior Publication Data

US 2009/0022014 A1 Jan. 22, 2009

(30) Foreign Application Priority Data

Dec. 8, 2005 (EP) ..... 05026819

(51) Int. Cl.
*G04B 37/00* (2006.01)
*A44C 5/00* (2006.01)

(52) U.S. Cl. ..... 368/88; 368/281; 368/283; 368/288

(58) Field of Classification Search ..... 368/88, 368/276, 281, 283, 286, 294, 309, 288
See application file for complete search history.

(56) References Cited

U.S. PATENT DOCUMENTS

| | | | | |
|---|---|---|---|---|
| 1,303,888 | A * | 5/1919 | Gruen | 368/283 |
| 1,493,248 | A | 5/1924 | Davidoff | |
| 1,804,048 | A | 5/1931 | Bosch | |
| 1,930,416 | A * | 10/1933 | Chauvot | 368/281 |
| 4,168,607 | A | 9/1979 | Friedman | |
| 4,493,561 | A * | 1/1985 | Bouchet | 368/281 |
| 6,079,872 | A * | 6/2000 | Besson | 368/281 |
| 2006/0034161 | A1 * | 2/2006 | Muller | 368/281 |
| 2007/0189127 | A1 * | 8/2007 | Pollak | 368/294 |

(Continued)

FOREIGN PATENT DOCUMENTS

| | | |
|---|---|---|
| CH | 138061 | 4/1930 |

(Continued)

OTHER PUBLICATIONS

International Search Report with annex issued in corresponding application No. PCT/EP2006/069363, completed May 9, 2007 and mailed May 18, 2007.

*Primary Examiner* — Vit M Miska
(74) *Attorney, Agent, or Firm* — Griffin & Szipl, P.C.

(57) ABSTRACT

The timepiece includes a stationary outer case (1) in which a pivoting inner case (10) is hinged in an inclined position via the action of a spring. The locking/unlocking mechanism is characterized in that it is formed by a mobile element of the external part that can be manipulated in the plane of the timepiece such as a rotating bezel (20) of the inner case (10) including a lug (22) that is engaged in a groove (2) of the outer case (1).

7 Claims, 4 Drawing Sheets

U.S. PATENT DOCUMENTS

| | | | | |
|---|---|---|---|---|
| 2008/0037375 | A1 * | 2/2008 | Ellner et al. | 368/88 |
| 2008/0144446 | A1 * | 6/2008 | Karterman | 368/88 |

FOREIGN PATENT DOCUMENTS

| | | | |
|---|---|---|---|
| CH | 161610 | | 7/1933 |
| CH | 208583 | | 5/1940 |
| CH | 343946 | | 2/1960 |
| DE | 706735 | | 6/1941 |
| DE | 1 670 977 | | 1/1955 |
| GB | 539824 | * | 9/1941 |

* cited by examiner

TIMEPIECE WITH A PIVOTING CASE

This is a National Phase Application in the United States of International Patent Application No. PCT/EP2006/069363 filed Dec. 6, 2006, which claims priority on European Patent Application No. 05026819.2, filed Dec. 8, 2005. The entire disclosures of the above patent applications are hereby incorporated by reference.

FIELD OF THE INVENTION

The present invention concerns a timepiece with a case carrying a movement that can pivot about the hinge of a stationary case, such as a wristwatch that may have a chronograph function.

BACKGROUND OF THE INVENTION

In order to make it easier to read the time when the watch is worn on the wrist, or to enable it to be used as a table clock, it has long been proposed to have a first stationary case, attached to the wrist by the strands of a bracelet or wristband or able to be placed on a table, and a second case, which contains the watch movement and is mobile and hinged in the first case, and which can take a first position in which it is locked in the stationary case and a second position in which it can adopt an inclined position.

U.S. Pat. No. 1,804,048 already discloses a device wherein the mobile case can be unlocked by pressing a push-button passing through the middle part of the watch. In CH Patent No. 161 610, the display is concealed when the two cases nest inside each other, and made visible by pivoting the mobile case by gripping a lip arranged at 12 o'clock. In the device disclosed in CH Patent No. 343 946, one side of the middle part of the stationary case is removed to allow a corresponding middle part portion of the mobile case to be gripped in order to unlock the latter against the bias of a spring and pivot said case. In U.S. Pat. No. 4,168,607, the mobile case is also brought into a raised position via the action of a strip spring arranged in the back cover of the stationary case, by pressing a push-button as in the first document cited.

These devices of the prior art may protect or conceal the crown or another control member, but they have the drawback of either leaving a push-button or an unlocking lip visible, or of comprising a recess in the middle part, which, in both cases, is awkward to manipulate or unattractive.

SUMMARY OF THE INVENTION

It is thus an object of the present invention to overcome the drawbacks of the aforecited prior art by providing a timepiece and more particularly a watch including two cases nesting inside each other, the inner case carrying the movement being able to adopt an inclined position relative to the outer stationary case by the action of a finger on a mobile element and the external part in order to impart thereto a movement along the plane of the timepiece to cause the unlocking of the mobile case.

The invention therefore concerns a timepiece and more particularly a wristwatch including a stationary external case and a pivoting internal case carrying the movement and a display for time related data or non-time related data. The inner case is hinged about an axis parallel to the direction in which data is read and arranged in the bottom part of the display, i.e. at 6 o'clock in the case of an analogue display. The inner case is kept in the normal position in the stationary case by locking means and can occupy an inclined position via the action of a spring when said locking means are deactivated. The invention is characterized in that the locking means are formed by a mobile element of the external part that can be manipulated in the plane of the timepiece in rotation or in translation. In other words, the timepiece no longer includes push-button or lip type locking means.

This mobile element of the external part of the watch can form part of either the inner case or the outer case. When it forms part of the inner case, it is preferably formed by a rotating bezel. When it forms part of the outer case, it is preferably formed by a sliding shutter arranged in the top part of the bezel-middle part.

With the exception of timepieces controlled entirely tactilely by means of sensors arranged on the glass, projecting control means, such as a crown or pushers in the case of a chronograph watch, are necessary, but said control means can be damaged in the event of a shock and are not necessarily attractive.

According to another aspect of the invention, the outer case protects the control members, and the mobile element could conceal them.

According to a first embodiment, the mobile element is a rotating bezel secured to the inner case and may have an asymmetrical external contour if the timepiece is provided with control members to which easy access is necessary in the pivoting position, for example in the case of a chronograph watch. The mobile element may also be only one sector of a bezel that is mobile in rotation.

According to a second embodiment, the mobile element is a sliding shutter arranged in the top part of the bezel-middle part of the external case. If the timepiece is provided with control means, the shutter may be arranged on said control members so that the latter can be concealed in the normal position.

BRIEF DESCRIPTION OF THE DRAWINGS

Other features and advantages of the present invention will appear in the following description of various embodiments given by way of non-limiting illustration, with reference to the annexed drawings, in which.

DETAILED DESCRIPTION OF THE INVENTION

With reference first of all to FIGS. 1 to 11, we will describe below a first embodiment of a chronograph watch with a pivoting case, and the way in which the display passes from a normal position to a pivoted position allowing more convenient reading of the information displayed on the dial and giving access to the control, time-setting, chronograph function or other members.

Figure 1:
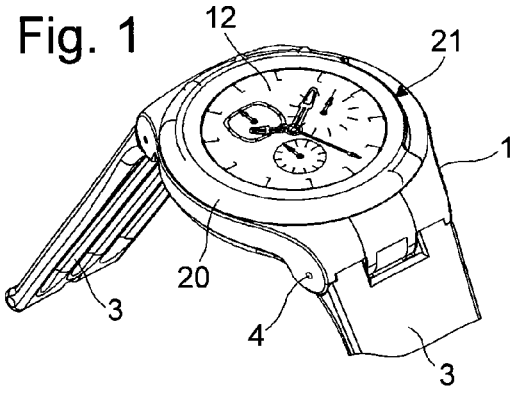
FIGS. 1 and 2 show in perspective a first embodiment of a wristwatch according to the invention respectively with the inner case in the normal position and in the pivoted position.

FIG. 1 is a perspective diagram in the "normal" position, i.e. as a wristwatch is usually seen when worn on the wrist, with one exception: there are no control members visible on the middle part of outer case 1 which allows bracelet or wristband strands 3 to be attached.

The only visible part is a display 12, which in this example is an analogue display with a chronograph function, and a bezel 20 having an asymmetrical shape with, in particular, a recess 21 in the external contour thereof. Bezel 20 is a rotating bezel which can be manipulated in rotation in the plane of the watch.

Figure 2:
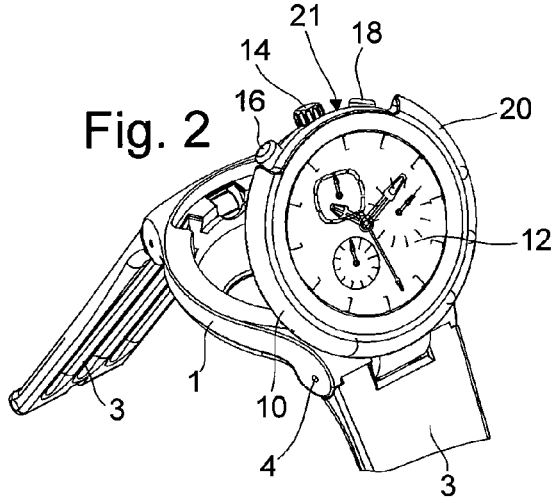
Figure 3:
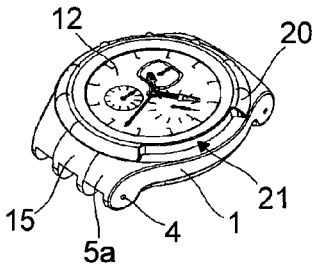
FIGS. 3, 4 and 5 show schematically the manipulations to be carried out in order to make the inner case pass from the normal position to the pivoted position.
Figure 4:
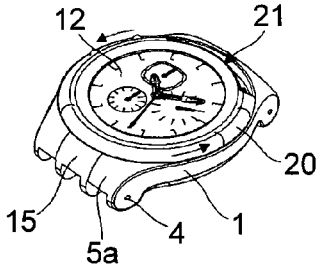
Figure 5:
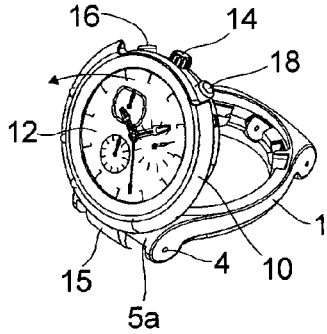

The same watch is shown in the "pivoted" position in FIG. 2, facilitating, when it is worn on the wrist, the reading of information on display 12 and uncovering the control members, such as a crown 14 and two push buttons 16, 18. The manner in which the passage from the normal position to the pivoted position is achieved will be better understood by referring also to the diagrams of FIGS. 3, 4 and 5. Starting from the normal position (FIG. 3), a rotation of a certain angle (FIG. 4) is imparted to rotating bezel 20 which will position recess 21 above the place where control members 14, 16 and 18 are located and which will cause, via the action of a helical torsion spring 7, not visible in these Figures, an inner case 10 to pivot, enclosing the watch movement with its display 12, and the control members 14, 16 and 18. This pivoting occurs about a pin 4, arranged at 6 o'clock and passing through extensions 5, 15 of cases 1 and 10.

Figure 6:
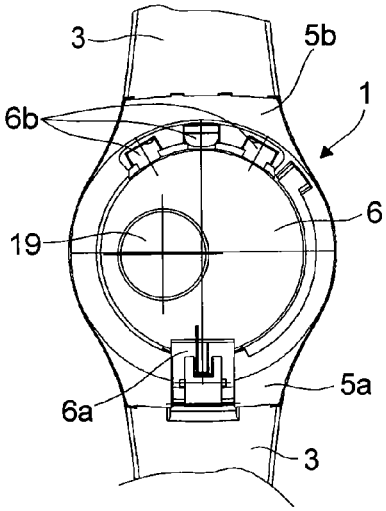
FIGS. 6, 7 and 8 show the various parts to be assembled in order to obtain the watch of FIG. 1.
Figure 7:
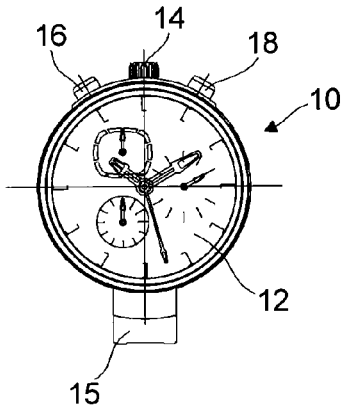
Figure 8:
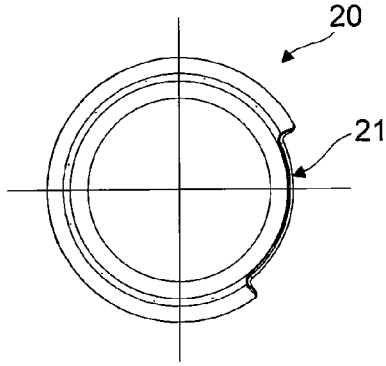

FIGS. 6, 7 and 8 show a top view of the various parts to be assembled to obtain the watch shown in FIGS. 1 and 2.

FIG. 6 shows that the outer case 1 includes a cavity 6 whose contour corresponds to that of the external contour of pivoting case 10 shown in FIG. 7. The extensions 5*a*, 5*b* along the direction of bracelet strands 3 include in particular housings 6*a*, 6*b* for receiving respectively control members 14, 16 and 18 and extension 15 of inner case 10. As FIG. 8 shows, in the example shown, rotating bezel 20 has an asymmetrical shape with a recess 21. It is clear that the shape of bezel 20 is adapted to the contour of the stationary case, to any desired aesthetic effect and to the type of movement and control members integrated in said watch. It is, for example, possible to have a bezel with an oblong shape along the direction of the bracelet strands and an elongated part of which covers the control members in the locked position, and the narrow part of which uncovers said members in the pivoted position after rotation of said bezel.

In the case of a watch with purely tactile control via sensors arranged on the glass, and thus not provided with any control members located on the middle part of pivoting case 10, or a watch whose control members one wishes to leave permanently visible, it is even possible to have a perfectly circular ring-shaped bezel which is manipulated for the sole purpose of making the inner case pass from the normal position to the pivoted position or vice versa. In such an embodiment, it is even possible to limit the mobile element to a bezel sector that can be manipulated in rotation between each locked position.

Figure 9:
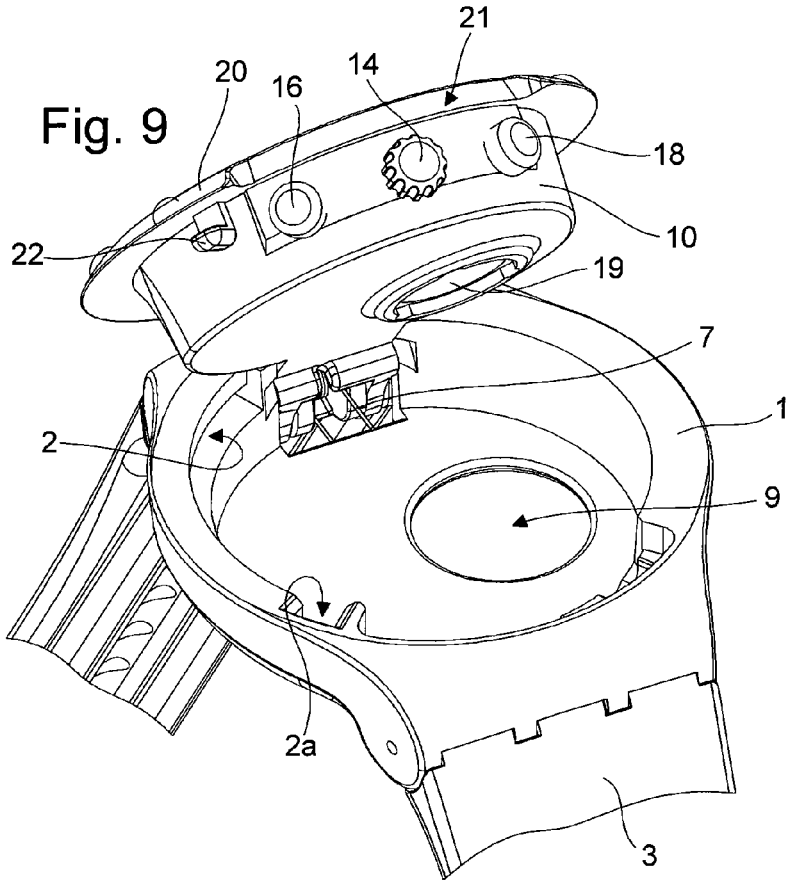
FIG. 9 is a perspective view corresponding to FIG. 2 at an angle showing one part of the locking mechanism.
Figure 10:
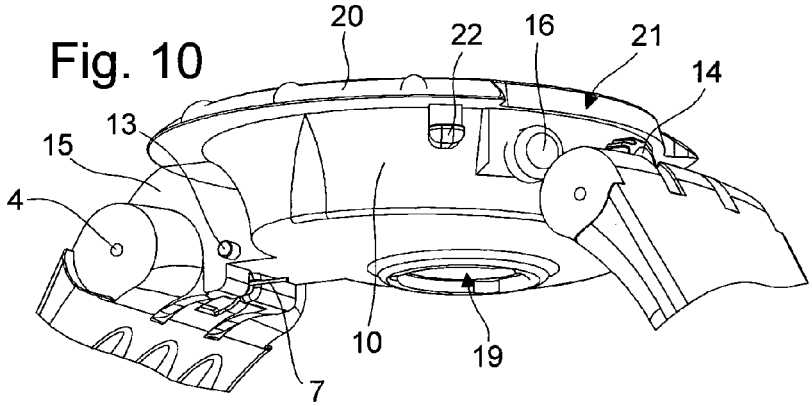
FIG. 10 corresponds to FIG. 9 without the outer case.
Figure 11:
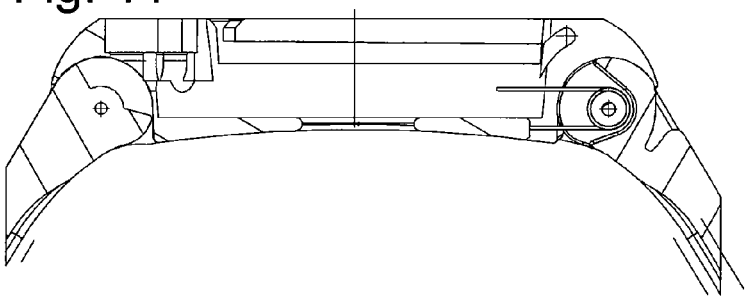
FIG. 11 is a broken cross-section of the watch shown in FIG. 1, along the 2 o'clock-6 o'clock axes.

Referring more particularly now to FIGS. 9, 10 and 11 we will describe below the locking/unlocking mechanism for passing from the normal position to the pivoted position.

The angle at which the watch is shown in the pivoted position in FIG. 9 shows that bezel 20 includes in the lower part thereof an L-shaped lug 22, the small arm of which is oriented outwards in order to cooperate with a groove 2 of external case 1, along the principle of a bayonet assembly, through a passage 2*a* between said groove 2 and the shoulder of the middle part of outer case 1.

It is clear that the length of groove 2 may be limited to the length that is merely sufficient to allow the rotation of bezel 20 between a position where recess 21 is above control members 14, 16, 18 and a position where the widest part of the bezel conceals them. In the case of a perfectly circular bezel 20, either because the movement has no control members projecting onto the middle part of the pivoting case, or because one has chosen to leave the control members permanently visible, the length of groove 2 may be limited to the width of the small arm of L-shaped lug 22. Likewise, it is possible to provide more than one locking lug, for example by arranging two lugs symmetrically relative to the centre of rotation of the rotating bezel.

It can also be seen that the pivoting case 10 includes a battery compartment 19, opposite a corresponding aperture 9 in stationary case 1, in order to facilitate battery replacement. The cover of compartment 19 is actually quite inaccessible, even in the pivoted position.

Indeed, as can be seen in FIG. 10, in which outer case 1 is not shown, the clearance of pivoting case 10 is limited by a stud 13 positioned in a lower part of extension 15 of the pivoting case. It is clear that other equivalent devices could be used to control the pivoting angle.

This Figure also shows the end of helical torsion spring 7, whose coils are contained in a housing 8 of extension 15 of pivoting case 10. The other end of spring 7 abuts against the back cover of stationary case 1.

FIG. 11 is a broken cross-section passing through the centre of the dial and through the 2 o'clock and 6 o'clock positions. This cross-section shows more clearly the location of housing 8 of helical torsion spring 7. As the location is in an extension 5*a* of stationary case 2 for securing the bracelet strands, it does not in any way change the thickness of the case and the overall aesthetic appearance of a watch that would not be provided with such a device. This cross-section also shows more clearly the location of groove 2 in which lug 22 engages.

In the description of this first embodiment, the helical torsion spring 7 is given solely by way of example. It is in fact possible to use other types of spring, for example a strip spring, or other elastic means.

FIGS. 12 to 22 describe a second embodiment, relying on the same principle but which differs from the embodiment just described in the arrangement of the locking/unlocking device. Elements that are identical or similar to those of the first embodiment are designated by the same references.

Figure 12:
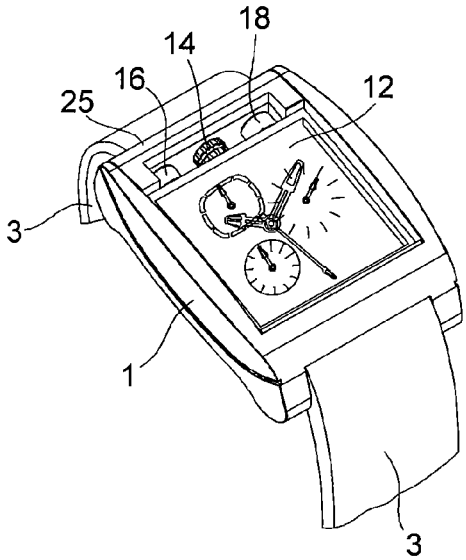
FIGS. 12 and 13 show in perspective a second embodiment respectively with the inner case in the normal position and in the pivoted position.
Figure 13:
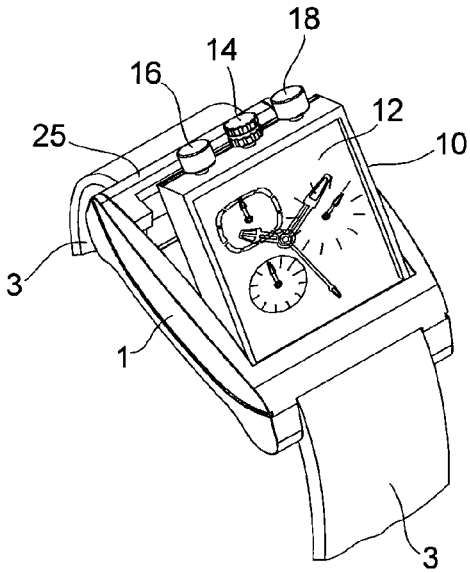

FIGS. 12 and 13 show a chronograph wristwatch of rectangular shape whose control members, formed by a crown 14 and two push buttons 16, 18, are arranged in the upper part of display 12, substantially between the horns for securing the bracelet strands 3, with no other control member being visible on the middle part of outer stationary case 1.

FIG. 12 shows this watch in perspective in the normal position, members 14, 16, 18 being visible but not accessible. FIG. 13 shows the same watch in which the inner case 10 is in the pivoted position, i.e. a position allowing better reading of display 12 and providing access to control members 14, 16, and 18.

Figure 14:
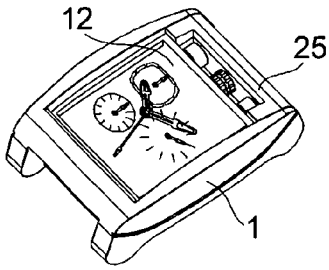
FIGS. 14, 15 and 16 show schematically the manipulations to be carried out to make the inner case pass from the normal position to the pivoted position.
Figure 15:
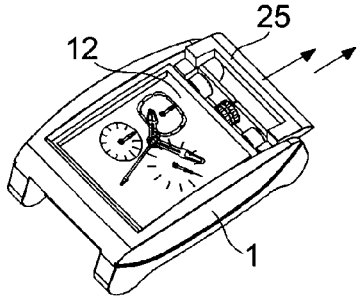
Figure 16:
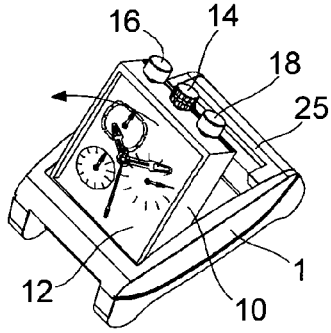

Referring also to FIGS. 14, 15 and 16 we will explain below how the passage from the normal position to the pivoted position is carried out. Starting from the normal position (FIG. 14), a finger is used to slide a shutter 25 (FIG. 15) towards the exterior of the case, which, via the action of a spring that is not visible in the Figures, will cause an inner case 10 (FIG. 16) to pivot enclosing the watch movement with its display 12, and the control members 14, 16 and 18, said pivoting occurring about pivoting points in the lower part of an outer case 1 for securing bracelet strands 3.

FIGS. 17 to 22 describe in more detail an embodiment that allows the sliding shutter to lock/unlock pivoting case 10.

Figure 17:
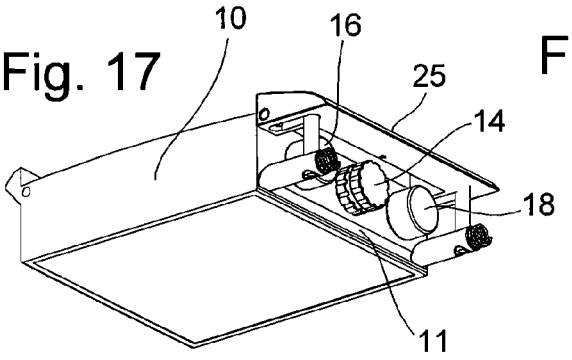
FIGS. 17 and 18 show in perspective only the inner case and the shutter in the locked and unlocked position.
Figure 18:
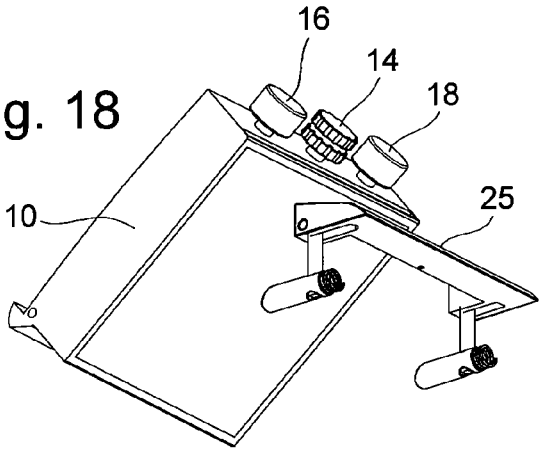
Figure 19:
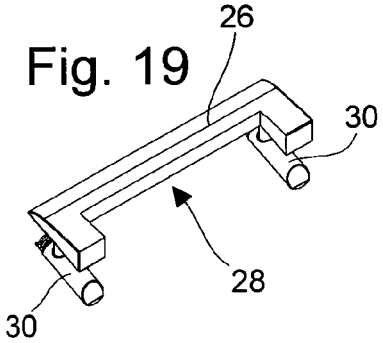
FIGS. 19, 20, 21 show in perspective only the shutter at three different angles.
Figure 21:
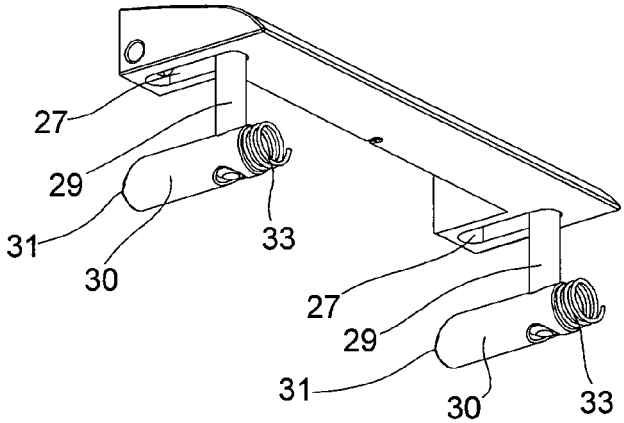
Figure 20:
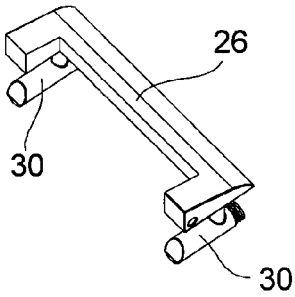
Figure 22:
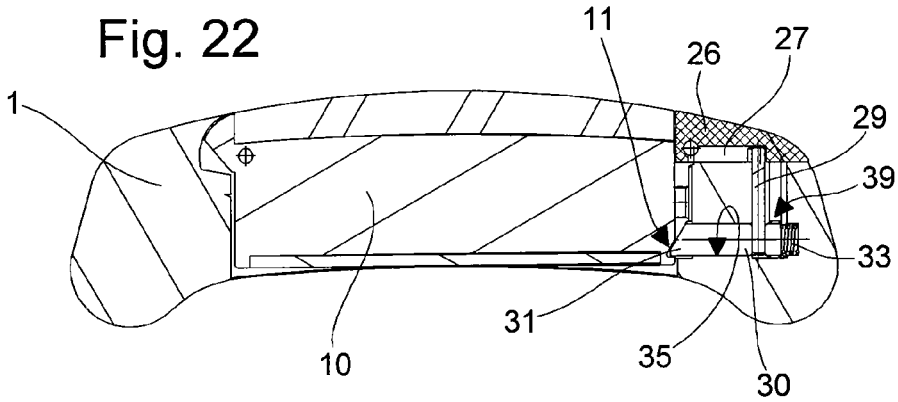
FIG. 22 is a cross-section of the watch shown in FIG. 12, passing through the locking device.

FIGS. 17 and 18 show in perspective only pivoting case 10 and shutter 25, also shown at different angles in FIGS. 19, 20 and 21.

Shutter 25 is formed by a substantially rectangular plate 26 which, in the example shown in FIGS. 12 to 16 includes a recess 28 leaving control members 14, 16, 18 permanently visible in the normal position. As shown in FIG. 20, plate 26 can also be provided without a recess if, conversely, one wishes to conceal the control members in the normal position.

Plate 26 includes, in the lower part thereof that has to slide over a shoulder of the middle part of stationary case 1, two parallel grooves 27 close to the edges of the small sides of plate 26.

Grooves 27 are closed at each end and limit the travel of shutter 25 and activate the system for unlocking pivoting case 10.

Each groove 27 is in fact provided for receiving the end of a stud 29 secured perpendicularly to a slide block 30, housed in a slide way 35 arranged in the middle part of stationary case 1, close to the back cover thereof, and open towards the interior of said stationary case 1. Stud 29 passes through the middle part via a sink 39 of oblong shape.

The end of slide block 30 directed towards the interior of stationary case 1 includes a bevel 31 and the other end directed towards the bottom of slide way 35 is provided with a helical compression spring 33 abutting on the bottom of slide way 35.

Referring to the normal position, shown in FIGS. 12, 14 and 17, it can be seen that spring 33 forces bevel 31 of slide block 30 to engage in a groove 11 of pivoting case 10, located close the back cover thereof, below control members 14, 16, 18.

In order to pass to the pivoted position, shown in FIGS. 13, 16 and 18, shutter 25 is made to slide outwards. In a first phase (FIG. 15) the case remains in the normal position, the end of stud 29 sliding only in groove 27 to position shutter 25 beyond control members 14, 16 and 18. When stud 29 reaches as stop at the bottom of groove 27, an additional thrust compresses spring 33, releases bevels 31 from groove 21 and thus pivots inner case 10 via the action of a spring that is not shown but that can have the same arrangement as the spring of the first embodiment. The largest dimension of sink 39 of oblong shape must therefore match the necessary clearance of slide block 30 in order to totally release bevel 31 from groove 11.

For a shutter 25 whose plate 26, has a recess 28, which is the case of the example illustrated more particularly, it is clear that the stud may simply be secured, for example by being driven into the base of plate 26.

Other variants may be envisaged, particularly as regards the shapes of the cases and the mobile element for locking/unlocking, without departing from the scope of this invention.

What is claimed is:

1. A timepiece comprising:

(a) a stationary outer case; and (b) a pivoting inner case, the pivoting inner case carrying a movement, a display for time related data or non time related data, and, on a middle part thereof, control members, wherein the pivoting inner case is hinged around an axis parallel to a direction in which the data is displayed and is arranged in the bottom part of the display, wherein the pivoting inner case is held in a locked position in the stationary case by locking means and able to occupy, via the action of a spring, an inclined position when said locking means are deactivated, wherein the locking means comprise a mobile element associated with the inner case of the timepiece that can be manipulated in a plane of the timepiece in order to protect said control members in the outer case in the locked position, and wherein the mobile element is a rotating bezel including at least one lug able to be positioned opposite a groove formed in an inner wall of the outer case and to be engaged in said groove to lock said inner case when said bezel is rotated.

2. The timepiece according to claim 1, wherein the mobile element has a contour that can also conceal and/or protect the control members in the locked position, and uncover said members in the unlocked position.

3. The timepiece according to claim 2, wherein the control members are arranged at a position adjacent a 12 o'clock position.

4. A timepiece comprising:

(a) a stationary outer case; and (b) a pivoting inner case, the pivoting inner case carrying a movement, a display for time related data or non time related data, and, on a middle part thereof, control members, wherein the pivoting inner case is hinged around an axis parallel to a direction in which the data is displayed and is arranged in the bottom part of the display, wherein the pivoting inner case is held in a locked position in the stationary case by locking means and able to occupy, via the action of a spring, an inclined position when said locking means are deactivated, wherein the locking means comprise a mobile element associated with the outer case of the timepiece that can be manipulated in a plane of the timepiece in order to protect said control members in the outer case in the locked position, and wherein the mobile element is a sliding shutter arranged in the top part of the outer case, said shutter being able to lock the inner pivoting case and unlock said case when said shutter is made to slide.

5. A timepiece formed by a wristwatch comprising:

(a) a stationary outer case; and (b) a pivoting inner case, the pivoting inner case carrying a movement, a display for time related data or non time related data, and, on a middle part thereof, control members, wherein the pivoting inner case is hinged around an axis parallel to a direction in which the data is displayed and is arranged in the bottom part of the display, wherein the pivoting inner case is held in a locked position in the stationary case by locking means and able to occupy, via the action of a spring, an inclined position when said locking means are deactivated, wherein the locking means comprise a mobile element of an external part of the timepiece that can be manipulated in a plane of the timepiece in order to protect said control members in the outer case in the locked position, and wherein an articulation pin of the inner and outer cases is merged with a bar for securing a bracelet strand.

6. The timepiece according to claim 5, wherein means for securing the bar include a housing for the spring causing the inner case to pivot.

7. A timepiece comprising:

an outer case;

an inner case which is received in the outer case, the inner case carrying a movement, a constantly exposed display and control members, the control members being grouped in predetermined location on a peripheral edge of the inner member;

a hinge interconnecting the stationary outer case and the edge of the inner case at a location distal from the control members, the hinge having a spring which biases the inner case to pivot about the hinge from a first position wherein inner case is lying in the outer case and the control members are located in an enclosed position within the outer case, to a second position angled up out of the outer case and wherein the control members are located in an exposed manually accessible position; and a locking arrangement which defines a portion of a flat external surface of one of the outer case and the inner case and which moves in a direction essentially parallel with a plane of the display when the inner case is disposed in the outer case, so as to lock the inner case within the outer case and protectively enclose the control members.

* * * * *